US008973476B2

(12) United States Patent
Reynertson, Jr. et al.

(10) Patent No.: US 8,973,476 B2
(45) Date of Patent: Mar. 10, 2015

(54) RATCHETING TORQUE WRENCH

(71) Applicant: Ryeson Corporation, Carol Stream, IL (US)

(72) Inventors: John Reynertson, Jr., Geneva, IL (US); Vladimir Kunin, Wheeling, IL (US)

( * ) Notice: Subject to any disclaimer, the term of this patent is extended or adjusted under 35 U.S.C. 154(b) by 197 days.

(21) Appl. No.: 13/800,636

(22) Filed: Mar. 13, 2013

(65) Prior Publication Data

US 2014/0260836 A1 Sep. 18, 2014

(51) Int. Cl.
*B25B 13/46* (2006.01)
*B25B 23/142* (2006.01)

(52) U.S. Cl.
CPC ..... *B25B 13/463* (2013.01); *B25B 23/1422* (2013.01)
USPC ..... 81/478; 81/63.1

(58) Field of Classification Search
USPC ..... 81/467, 480, 481, 58, 58.4, 63.1
See application file for complete search history.

(56) References Cited

U.S. PATENT DOCUMENTS

| | | | | | |
|---|---|---|---|---|---|
| 2,768,547 | A * | 10/1956 | Noell | 81/480 |
| 2,826,107 | A * | 3/1958 | Woods | 81/480 |
| 2,897,704 | A * | 8/1959 | Woods | 81/481 |
| 3,290,969 | A * | 12/1966 | Bergquist et al. | 81/63.1 |
| 5,301,574 | A * | 4/1994 | Knopp et al. | 81/57.39 |
| 5,557,994 | A * | 9/1996 | Nakayama | 81/478 |
| 6,789,449 | B2 * | 9/2004 | Liu | 81/63.2 |
| 7,096,763 | B1 * | 8/2006 | Hsieh | 81/63.2 |
| 2003/0019334 | A1 * | 1/2003 | Wei | 81/63.1 |
| 2004/0083859 | A1 * | 5/2004 | Chang | 81/63.1 |
| 2010/0018356 | A1 * | 1/2010 | Hu | 81/63.1 |

* cited by examiner

*Primary Examiner* — David B Thomas

(57) ABSTRACT

A new ratchet wrench has a slide gear that is laterally enclosed within the head. Shoulders on the slide gear are curved and outwardly flanked by a single recess. The distance from the top of the shoulder to the base of the recess is no more than half the difference between the outside diameter and the root diameter of the teeth on the ratchet. Those teeth have essentially planar faces, top lands that traverse at least one quarter of the pitch, and bottom lands that extend continuously from the faces, have essentially constant radius, and traverse at least one quarter of the pitch. A pin projects out the back and enables a user to shift the wrench between clockwise and counterclockwise ratcheting. All cavities for the ratcheting assembly are recessed from the face in an arrangement that can be machined in a single set-up on a computer-controlled vertical mill.

20 Claims, 6 Drawing Sheets

RATCHETING TORQUE WRENCH

FIELD OF THE INVENTION

The present invention relates generally to ratchet wrenches, and more particularly to ratcheting torque wrenches commonly used in the aircraft and automotive industries.

BACKGROUND

In many industrial applications, the tightening of threaded fasteners to a specific degree or torque is of critical importance. In the assembly of automobiles or aircraft, it is imperative that nuts, bolts, screws, lugs, and the like (which, for brevity, will all be referred to as "bolts") are sufficiently tightened to ensure that the resulting assembly functions properly not only at initial use, but over the long term. Overtightening, however, may strip the threads or cause vibrational problems in the assembly.

It has long been known to use torque wrenches to tighten bolts. Such wrenches not only enable the user to rotate and tighten bolts, but also provide the user with a visual, audible, or tactile indication of the amount of torque that has been applied. Some known arrangements include slipper type, beam type, deflecting beam type, click type, and electronic strain gauge type indicators. The click type torque indicator is frequently used in wrenches designed for use in automotive applications and often includes a calibrated clutch mechanism disposed in a handle, or lever arm, of the wrench. When a user has applied the pre-selected torque force, the clutch mechanism clicks, providing the user with both an audible sensation and a tactile sensation that the pre-selected torque force has been applied. U.S. Pat. No. 4,655,104 to Blattner describes one type of torque indicator in detail, and that disclosure is incorporated into this disclosure by reference.

The head of a torque wrench can be configured as a ratchet wrench. However, the amount of play that is provided in some ratchet wrenches can affect the accuracy of a torque indictor, so not all ratchet assemblies are always appropriate for use in torque wrenches.

Ratchet wrenches have a ratchet assembly that engages and drives the bolt when the wrench is rotated in one rotational direction and disengages when the wrench is rotated in the opposite direction, enabling the user to move the wrench without reversing the prior movement, and thus enabling a user to avoid the need to remove and reposition the wrench when further rotation in one direction becomes blocked or inconvenient. The type of slide gear ratchet assembly seen in U.S. Pat. No. 6,341,543 has a ratchet wheel, a slide gear with sets of opposed teeth, and a ball and spring assembly that releasably biases the teeth on the push bar against teeth on the ratchet wheel. A user can selectively switch the wrench so that one or the other of the sets of opposed teeth on the push bar engage the teeth on the ratchet, thus configuring the ratchet assembly so that it either drives when rotated in a clockwise direction and releases when rotated in a counterclockwise direction, or vice versa.

To enable a user to readily shift between one mode of operation and the other, the slide gear on the prior ratchet wrench is slidably disposed within a bore that extends laterally through the head. The slide gear is wider than the head, and one lateral end projects out one side of the head in one mode of operation, and the other lateral end projects out the other side of the head in the other mode of operation. The user switches the ratchet assembly between modes of operation by pressing the projecting end of the slide gear into the bore. This motion shifts one part of the slide gear out of engagement with the ratchet wheel and another part of the slide gear into engagement with another part of the ratchet wheel, and pushes the other end of the slide gear out of the other side of the head.

While the projection of the ends of the slide gear makes it easy for a user to shift the wrench between the two modes of operation, it also creates problems. First, the arrangement of the lateral bore requires multiple set-ups on a computer-controlled vertical mill, making it more time-consuming to machine the head of the wrench. Second, the projecting end of the slide gear creates a risk of unintentional shifts of the wrench between modes and operations. Because the ratchet wrench creates a single-ended torque couple, workers place the palm of one hand over the head of a wrench to counter the side force, and that hand can apply sufficient force on the projecting end of the slide gear to cause it to shift out of position. Third, the exposure of the bore and the slide gear to the environment creates a risk that dirt, metal dust, or other materials will enter between the two moving parts and ultimately damage the wrench.

The slide gear on the prior wrench has a rounded profile that enables an easier fit in the lateral bore and may provide some tolerance for debris in the slideway. However, axial rocking of the slide gear in the bore can lead to point contact between the teeth on the ratchet wheel and the teeth on the slide gear, and such contact significantly increases the stresses on the teeth and can lead to quicker breakage.

SUMMARY

A new ratcheting torque wrench has been developed. It is easier to manufacture (requiring only a single set-up on a vertical mill), less prone to accidental changes in mode, and better protected against conditions that lead to premature breakage.

Like the wrench disclosed in the U.S. Pat. No. 6,341,543, the new wrench has a head with a working face and an opposed rear face. A slide gear slides laterally in a slide channel in the head, and has a first (upper) side that faces a ratchet. A biasing element is arranged to urge the slide gear laterally into operative engagement with the ratchet in one of either of two ratcheting positions. In those positions, ratcheting occurs when rotation of the wrench causes part of the slide gear to engage an engaged tooth on the ratchet and push the slide gear toward a centerline of the wrench until the engaged part of the slide gear disengages from that engaged tooth. The biasing element then urges the slide gear away from the centerline of the wrench, where the slide gear engages a new engaged tooth.

Unlike in the prior wrench, the slide gear in the new wrench fits in a channel that is cut solely from the working face of the wrench. Enclosed ends on the head cover and seal the ends of the slide gear from the environment.

To move the wrench between the two ratcheting positions, a pin is used to selectively slide the slide gear laterally within the slide channel. The pin protrudes from a slot in the rear face of the wrench, and can be protected from inadvertent movement by recessing it within the rear face.

The slide gear has a generally rectangular configuration with rounded shoulders that engage teeth on the ratchet. Preferably, each shoulder is curved and outwardly flanked by a single recess, the radial distance from the top of the shoulder to the base of the recess being no more than half the difference between the outside diameter and the root diameter of the teeth on the ratchet. The teeth on the ratchet preferably have essentially planar faces, top lands that traverse at least one quarter of the pitch, and bottom lands that extend continuously from the faces, have essentially constant radius, and traverse at least one quarter of the pitch.

The ratchet sits in a ratchet recess that can be machined in the same machining operation used to cut the slide channel. The ratchet is preferably journaled over a centering journal in the ratchet recess. The centering journal may have a gapped wall that leaves a small gap between the ratchet and the journal.

Other aspects and forms of the invention will become apparent when reviewing the accompanying drawings, the following detailed description, and the claims that follow that.

DETAILED DESCRIPTION

Figure 1:
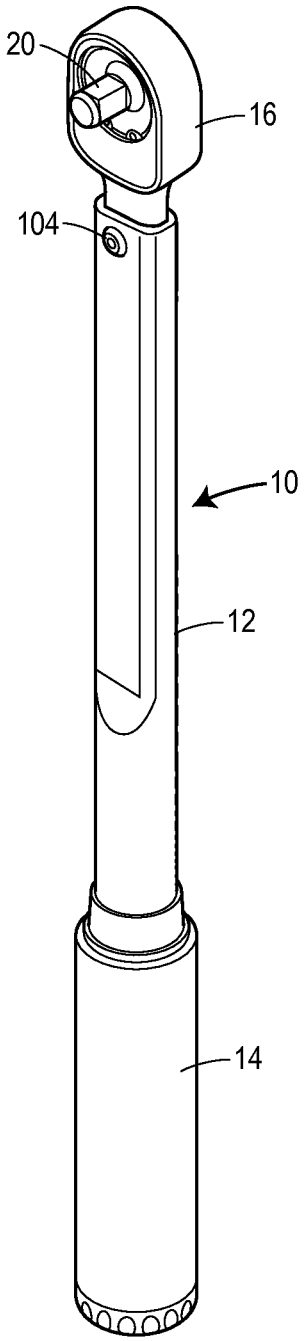
FIG. 1 is an isometric view of one example of a ratcheting torque wrench that utilizes the new invention.

The illustrated ratcheting torque wrench 10 has a lever arm 12, a grip 14 at a first end of the lever arm 12, and a head 16 at a second end of the lever arm 12. A ratchet assembly 20 is carried in the head 16.

Figure 2:
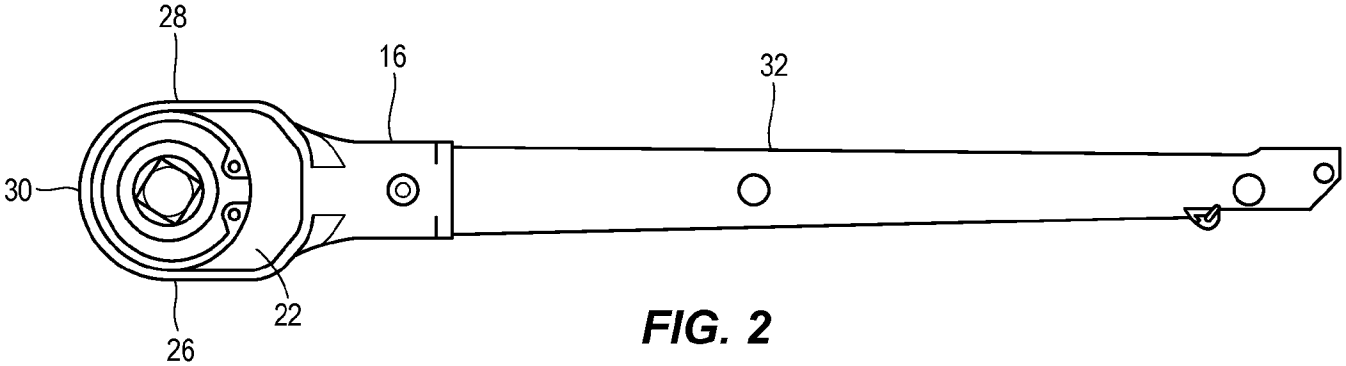
FIGS. 2-4 are front, side, and rear views of the head of the wrench seen in FIG. 1.
Figure 3:
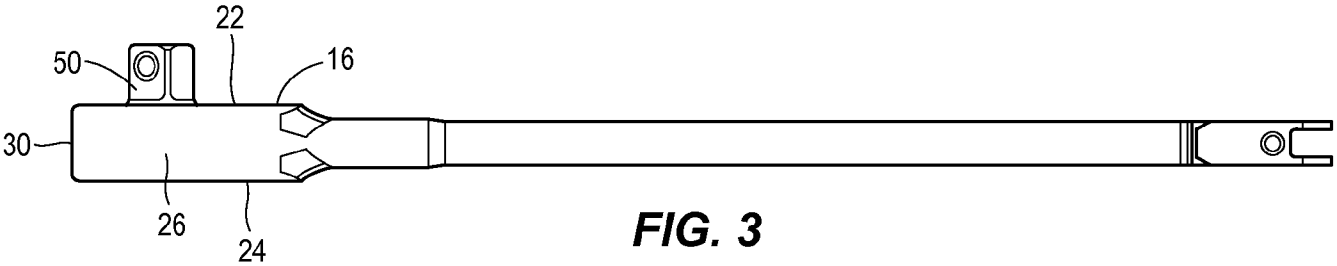
Figure 4:
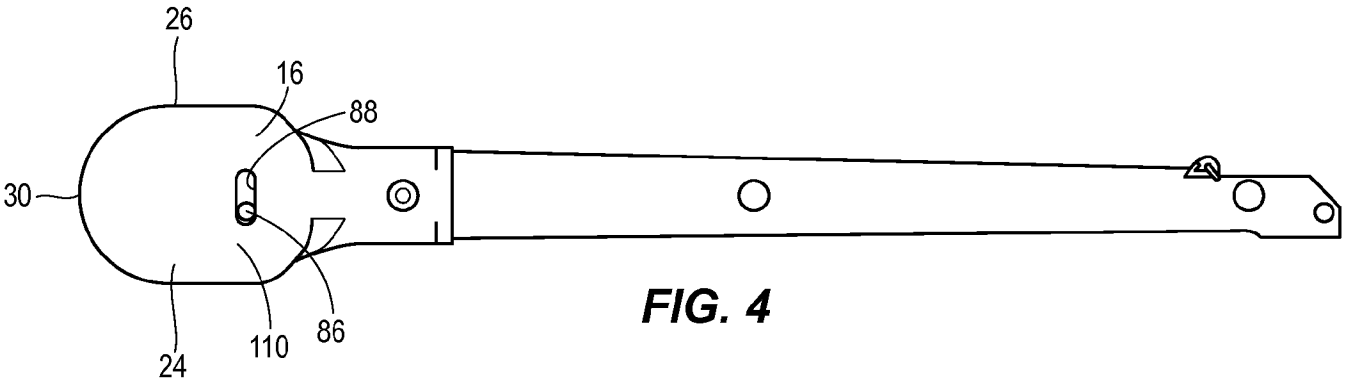

As best seen in FIGS. 2-4, the head 16 of the wrench 10 has a front or working face 22 opposite a rear face 24, a left lateral side 26, a right lateral side 28, a distal side 30, and a shank 32. (All directional descriptors, such as top, bottom, left, right, etc., are used solely for ease of reference with respect to the drawings and are not meant as limitations.) The left and right lateral sides 26, 28 and the distal side 30 are formed by one or more side wall sections that extend along and connect the outer peripheries of the working face 22 and the rear face 24. The shank 32 projects outwardly from the body opposite the distal side 30 and is operatively connected to the lever arm 12.

Figure 6:
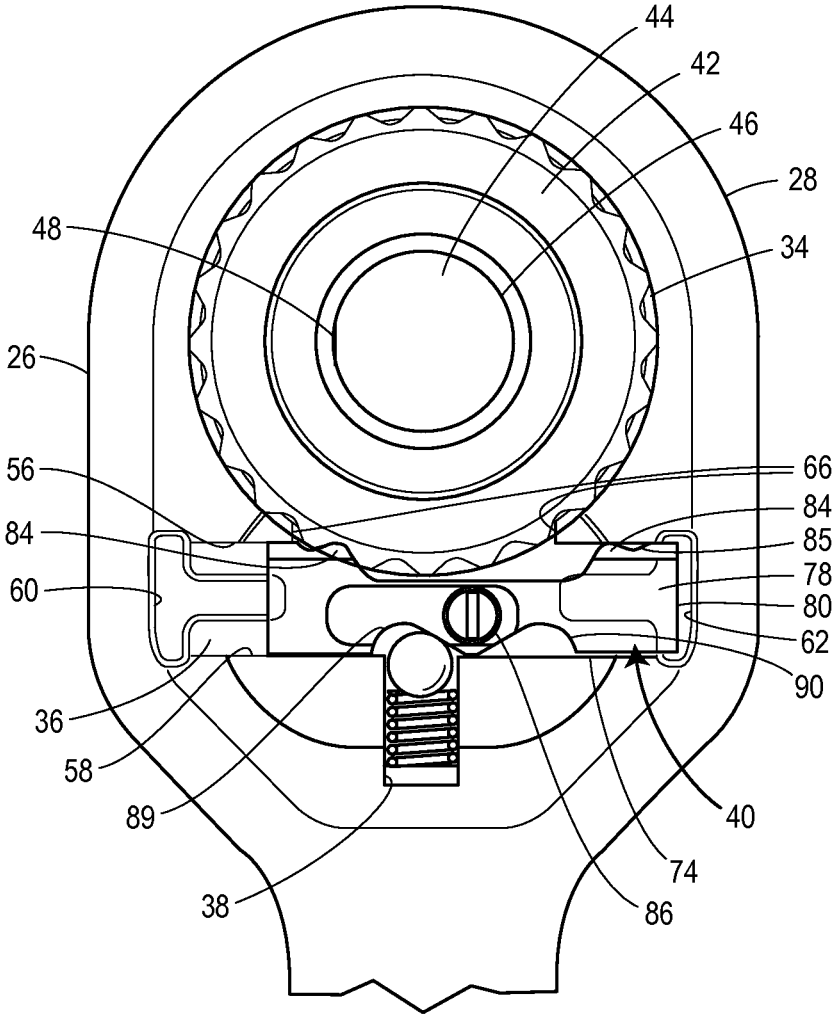
FIG. 6 is an enlarged axial cross-sectional view of the head along the lines 6-6 in FIG. 2.

As best seen in FIG. 6, a ratchet cavity 34 is disposed in the head 16 adjacent one side of a slide channel 36, and a spring cavity 38 is disposed adjacent an opposite side of the slide channel 36. The ratchet cavity 34, the slide channel 36, and the spring cavity 38 are all recessed into the working face 22 of the head 16 in an arrangement that enables each cavity/channel to be cut or formed in a single set-up on a computer controlled vertical mill.

The ratchet assembly 20 includes a double-acting pawl or slide gear 40, a ratchet, such as a ratchet wheel 42, and a biasing element, such as a spring 44 and ball 46 assembly, that resiliently and operatively engages the slide gear 40 against the ratchet.

The Ratchet Cavity and the Ratchet Wheel

The ratchet cavity 34 is a circular disc-shaped recess that is sized to accept the ratchet wheel 42. It has a centering journal 44 on which the ratchet wheel 42 is mounted. The ratchet wheel 42 has a generally disc-shaped body with a blind bore 46 (FIG. 6) disposed centrally in its rear face. This blind bore fits onto the centering journal 46 in the ratchet cavity 34, enabling the ratchet wheel to be mounted for rotation within the ratchet cavity 34. In a precision torque wrench, a tight fit is required. To accommodate this, it is preferred that at least a portion of the centering journal 44 has a slightly smaller radius than the blind bore of the ratchet wheel 42, forming a spaced wall that leaves a vent 48 (FIG. 6) between an inner diameter of the ratchet wheel 42 and the centering journal 44. This vent accommodates lubricant, such as oil.

A drive stem 50 is disposed centrally on the front face of the ratchet wheel 42 and projects outwardly from the working face 22 of the head 16. The drive stem could be a screwdriver or a wrench head such as a socket, but preferably is a conventional fitting with a spring-loaded ball detent mechanism that can be used to hold interchangeable sockets.

Figure 7:
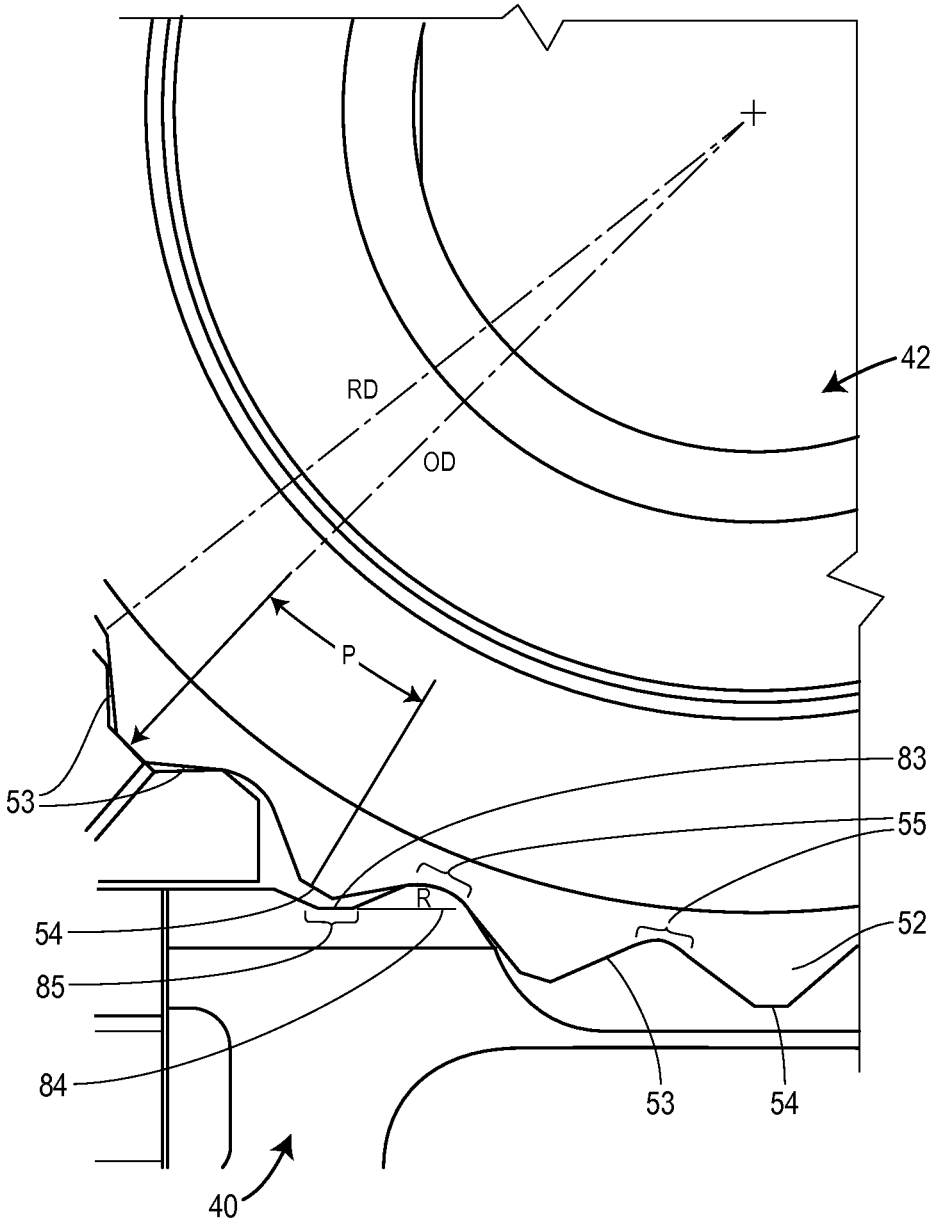
FIGS. 7 and 8 are enlarged views of the teeth and shoulders in two different embodiments of the invention.
Figure 8:
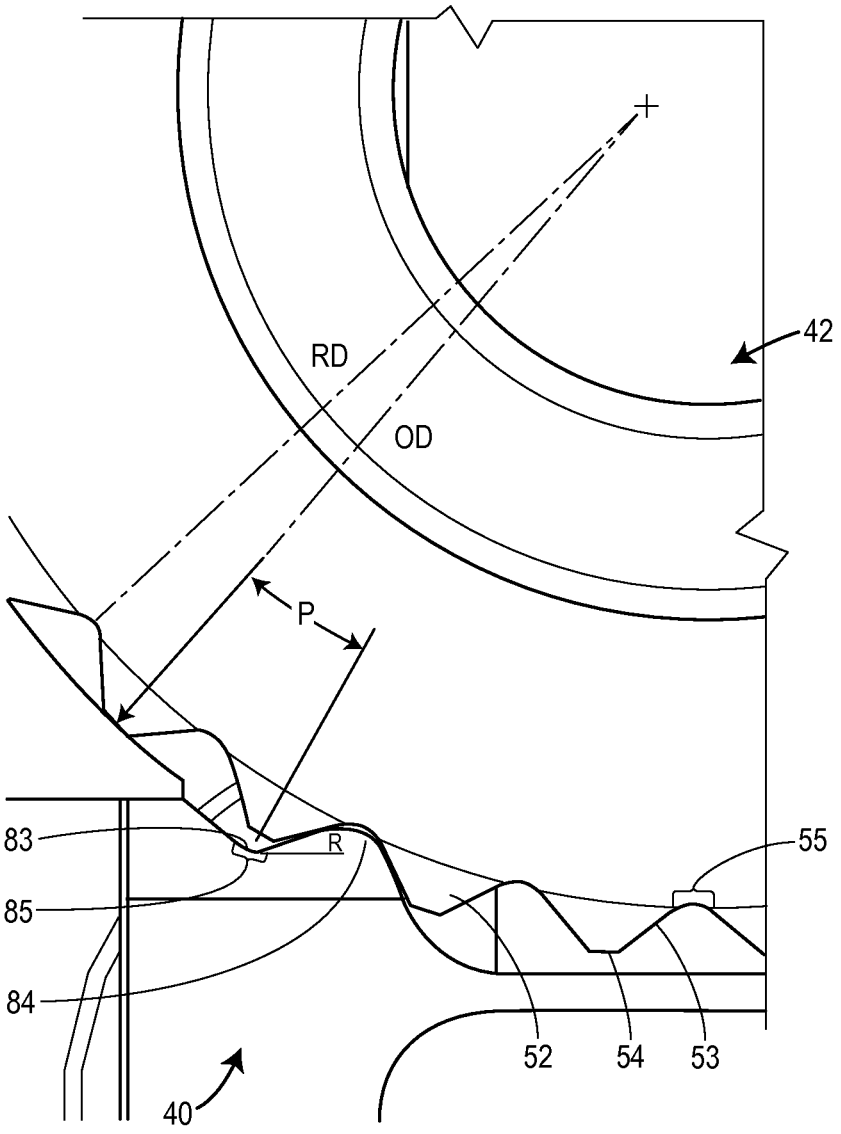

The ratchet wheel 42 has teeth 52 on a peripheral wall that extends around the outer circumferential periphery of the ratchet wheel between the front face and a rear face. As explained in more detail below, these teeth provide ratcheting engagement with the slide gear 40. Because the teeth cooperate with the elements of on the slide gear, the configuration of the teeth may affect the configuration of the shoulders, and vice versa. As best seen in the examples illustrated in FIGS. 7 and 8, the teeth preferably have essentially planar faces 53, top lands 54 that traverse at least one quarter of the pitch P, and bottom lands 55 that extend continuously from the faces, have essentially constant radius, and traverse at least one quarter of the pitch. Other arrangements may be suitable in these or other embodiments.

The Slide Channel and the Slide Gear

The slide channel 36 slidably receives the slide gear 40. The slide channel 36 is an elongate rectangular recess immediately adjacent and substantially tangent to the ratchet cavity 34. The slide channel 36 is aligned laterally, preferably perpendicularly, to the radius of the ratchet cavity 34. As best seen in FIG. 6, the slide channel 36 has a first (upper) side 56 that faces the ratchet cavity 34, a second side 58 that is opposite the first side 56, a left end 60, and a right end 62. A central portion of the first side 56 of the slide channel 36 intersects with an arc section of the ratchet cavity 34, forming an opening, such as a window 66, that connects the slide channel 36 and the ratchet cavity 34. The left end 60 of the slide channel 36 is closed by the left lateral side 26 of the head 16 and the right end 62 of the slide channel 38 is closed by the right lateral side 28 of the head 16. In use, the left lateral side 26 and the right lateral side 28 of the head prevent lateral access to the left and right ends 60, 62 of the slide channel 36 from outside of the head 16.

The slide gear 40 is preferably formed from a straight elongate rectangular bar that has a top side 72, a bottom side 74, a front side 76, a rear side 78, and generally rectangular left and right ends 80, 82. The slide gear is sized and shaped to fit closely within the slide channel 22, and should slide laterally relative to a radius of the ratchet wheel 42. The illustrated slide gear 40 is arranged to slide laterally left and right in the slide channel 36, and thus also slides laterally relative to an axis of the lever arm 12. In other arrangements, the path of the slide gear could be rotated clockwise or counterclockwise about the ratchet wheel 42, leaving it angularly offset from the shank 32.

To minimize rocking of the slide gear 40 within the slide channel 22, the intersections of the bottom side 74 with each of front side 76 and the rear side 78 define angular or sharp edges 75 rather than rounded edges. This helps to reduce rocking of the slide gear within the slide channel 44, and thus helps to reduce wear and limit fatigue on the teeth 52 by helping to maintain line contact with the teeth 52 on the ratchet wheel 42, rather than point contact.

The top (or upper) side 72 of the slide gear 40 has opposed first and second shoulders 84 that engage the teeth 52 on the ratchet wheel 42. One shoulder 84 is disposed at or adjacent the left end 80 of the slide gear and the second shoulder 84 is disposed at or adjacent the right end 82 of the slide gear. Each of the illustrated shoulders is outwardly flanked by a recess 85, such as those seen in the example arrangements seen in FIGS. 7 and 8. The base 83 of the recess is laterally spaced from the top of the shoulder by a distance of approximately ½ the pitch of the teeth on the ratchet wheel. Preferably, each shoulder is curved, and the radial distance R from the top of the shoulder to the base of the recess is no more than half the difference between the outside diameter OD and the root diameter RD of the teeth 52 on the ratchet wheel 42. The recess serves to accommodate a tooth on the ratchet wheel.

The slide gear 40 also has an engagement member, such as a pin 86, that projects outwardly from the rear side 78 of the slide gear. The pin 86 is located centrally on the rear side 78, and is accessible to a user through a slot 88 on a rear face 24 of the head 16. The pin 86 and the slot 88 enable the slide gear 40 to be selectively shifted between a clockwise ratcheting position and a counterclockwise ratcheting position without exposing the lateral ends 80, 82 of the slide gear to the environment. The area of the slot is smaller than the cross section of the end of the slide gear, and the perimeter of the slot (which forms the boundary where dirt or debris might enter the head) is not significantly larger than the perimeter of either lateral end of the slide gear. Thus, this arrangement not only reduces the risk of unintended switching of the slide gear between the two positions, but also exposes to the environment less moving perimeter than would be exposed in a comparable arrangement in which the ends of the slide gear would project out the sides of the head.

The Spring Cavity and the Spring and Ball Assembly

Although other biasing arrangements are possible, the illustrated wrench 10 uses a conventional spring 44 and ball 46 assembly to bias the slide gear 40. The illustrated spring cavity 38 is an elongate recess that opens into the second (lower) side 58 of the slide channel 36, opposite the window 66, and is preferably aligned radially with the ratchet cavity 34 and perpendicular to the slide channel 36. The illustrated spring cavity is also aligned axially with the shank 32, though this may not always be the case. The spring cavity receives the spring 44 and ball 46 assembly. The spring urges the ball up into the slide channel 39, where the ball cooperates with ramped recesses 89, 90 on the bottom side of the slide gear. The inner portions of the recesses are modestly sloped so that the pressure of the ball biases the slide gear away from a centered position within the slide channel, but can be overcome by sufficient force so that the slide gear can be moved far enough laterally to cause the ball to leave one recess and enter the other. The outer portions of the recesses are steep, and thus provide an effective outer limit on the range of travel of the slide gear.

Figure 5:
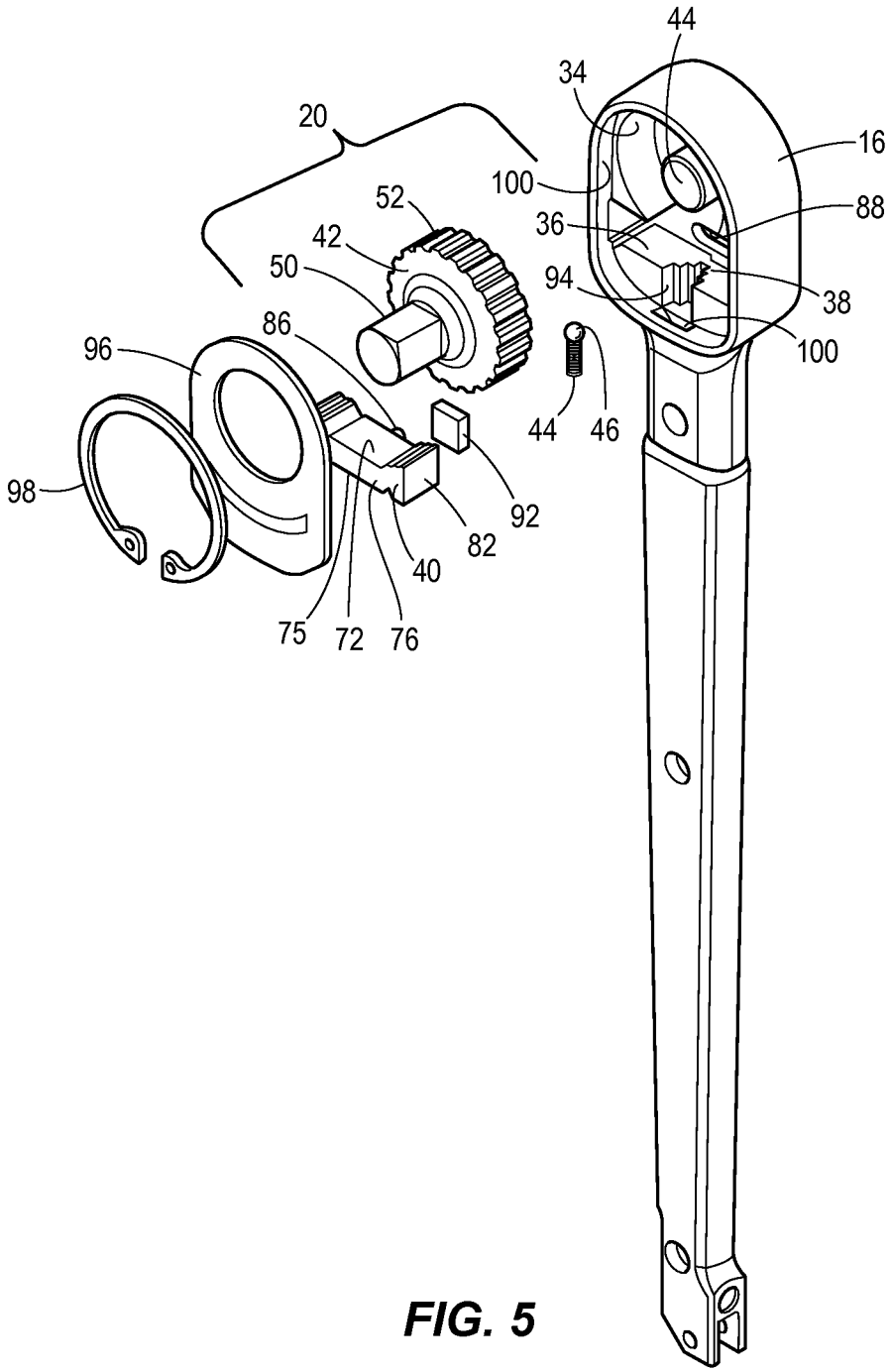
FIG. 5 is an exploded partial isometric view of the head of the ratchet wrench.

An optional spring cover 92 (FIG. 5) covers the spring cavity 38 on the side toward the working face 22, holding the spring 44 and the ball 46 within the spring cavity 38. The spring cover 92 may be press-fit or loosely fit into a recess 94 adjacent the spring cavity 38 and the slide channel 36.

Other Elements

The illustrated wrench has a face plate 96 that is disposed on the working face 22 of the head 16, covering the ratchet cavity 34, the slide channel 36, and the spring cover 92, and holding the ratchet assembly 20 inside the head 16. The illustrated face place 96 is locked in place by a locking clip 98 that resiliently engages an undercut, such as one or more grooves 100, that extends about portions of an inner periphery of the sidewall of the head 16 adjacent the working face 22.

The illustrated ratchet wrench 10 may have a torque indicator assembly (not shown) in the lever arm 12. For example, a click-type indicator that provides a clicking tactile and/or audible sensation when a pre-set torque force is achieved when tightening a bolt could be used. In many cases, any type of torque indicator that is presently known in the art or may be developed in the future could be used.

In the illustrated wrench, the shank 32 extends from the head 16 into the lever arm 12. The shank 36 is pivotably connected to the second end of the lever arm 12 with a pivot pin 104 in an arrangement that causes the ratchet head 16 to pivot about the pivot pin 104 when the pre-set torque force is reached. Further details are omitted here but can be found, for example, in U.S. Pat. No. 4,655,104. Other arrangements for operatively connecting the ratchet head 16 to the lever arm 12 can also or alternatively be used.

Ratcheting and Driving

FIG. 6 shows the slide gear 40 in the clockwise ratcheting position, in which the slide gear 40 is positioned toward the right end 62 of the slide channel 36, with the right end 68 of the slide gear 40 disposed near the right end 62 of the slide channel 36 and a gap or space between the left end 66 of the slide gear 40 and the left end 60 of the slide channel 36. The ball 46 is engaged in the ramped recess 89 on the left side of the slide gear. The shoulder 84 on the left side of the slide gear is disposed near the left end of the window 66 to the ratchet cavity 34 and engages between two teeth 52 on the ratchet wheel 42 that are to the left of the centerline of the wrench. The top of the tooth to the left is accommodated by the recess 85.

When the head is rotated in a clockwise direction CW, the shoulder 84 engages the adjacent tooth 52 to its left, away from the centerline of the wrench. Movement of the slide gear to the right within the slide channel is ultimately limited by the engagement of the ball 46 with a relatively perpendicular outer lateral wall on the ramped recess 89, and, in some embodiments, by bottoming of the shoulder in the bottom land 55 between adjacent teeth on the ratchet wheel 42. The rotational force will subsequently be transmitted through the engaged tooth and shoulder to the ratchet wheel and the drive stem 50, enabling the user to drive a bolt.

When the head 16 is rotated in a counterclockwise direction CCW, the shoulder 84 on the left side of the slide gear 40 engages the adjacent tooth 52 to its right, toward the centerline of the wrench. Movement of the slide gear to the left is only moderately resisted by engagement of the ball 46 with a sloped inner wall on the ramped recess 82, permitting the slide gear to move to the left within the slide channel 20 (as seen in the figure) as the wrench rotates about the ratchet wheel 42 until the shoulder clears the tooth. After the shoulder clears the tooth, the force of the spring 44 pressing the ball 46 against the sloped inner wall of the ramped recess 89 will urges the slide gear back to the right within the slide channel, where the slide gear will engage another (preferably the next) tooth on the ratchet wheel 42. Thus, the head 16 of the wrench rotates about the drive stem 50, providing a ratcheting action that enables the drive stem 50 to remain in place as the rest of the wrench rotates about it.

When the slide gear 40 is pushed to the left to a position where the ball 46 is engaged in the ramped recess 90 on the right, the wrench is set for driving when rotated in the counterclockwise direction CCW and for ratcheting when rotated in a clockwise direction CW. The shoulder 84 on the right side of the slide gear engages teeth 52 on the ratchet wheel 42 that are on right side of the centerline of the wrench as described above, but in the opposite directions. The shoulder 84 on the left remains out of contact with the ratchet wheel.

Changing Modes of Operation

As described above, the pin 86 projects outwardly through the lateral slot 88 in the rear face 24 of the head 16, and can be engaged by a user's thumb or finger to selectively slide the slide gear 40 laterally left and/or right within the slide channel 36 between the clockwise ratcheting position and the counterclockwise ratcheting position.

As best seen in FIG. 4, a recess 110 surrounding the slot 88 forms a depression or recessed bowl in the rear face 24 of the head 16. The outer or distal end of the pin 86 is preferably located at or below the outermost surface of the rear face 24 so that the distal end of the pin 86 does not extend beyond the exterior surface of the rear face 24. The recess 110 enables access to the side of the pin 86, such as by a user's thumb or finger, to facilitate pushing the pin 86 laterally along the slot 88. Having the distal end of the pin 86 flush with or below the outermost surface of the rear face 24, rather than extending outwardly beyond the outermost surface, can help prevent accidental switching of the slide gear 40 between the clockwise ratcheting position and the counterclockwise ratcheting position during use.

Additional modifications to the systems, apparatuses, and methods disclosed here will be apparent to those skilled in the art. Accordingly, this description should be construed as illustrative only, and is presented for the purpose of enabling those skilled in the art to make and use the invention. The exclusive rights to all modifications that come within the scope of the following claims are reserved.

The invention claimed is:

1. A tool that has:

a slide gear that slides laterally in a slide channel in a head that has closed sides that prevent access to the lateral ends of the slide channel;

a ratchet that is mounted for rotation within a ratchet recess in the head, and has a drive stem that protrudes from a face of the head;

two opposed shoulders that are on the slide gear and face the ratchet;

a biasing element that is selectively positionable in either a clockwise ratcheting position or in a counterclockwise ratcheting position, in each position the biasing element biasing the slide gear laterally to a position where one of the opposed shoulders engages an engaged tooth on the ratchet, but permitting sufficient rotational force to drive the engaged tooth and the slide gear away from a centerline of the wrench until the shoulder disengages from that engaged tooth, the biasing element subsequently driving the previously engaged shoulder back toward the centerline of the wrench, where the shoulder engages a new engaged tooth;

a pin that extends from the slide gear and protrudes from a rear face of the head, enabling a user to slide the slide gear laterally in the slide channel and thus to selectively arrange the tool in either the clockwise ratcheting position or the counterclockwise ratcheting position.

2. The tool of claim 1, in which the ratchet recess, the slide channel, and all required cavities for the biasing element are recessed from the working face in an arrangement that can be cut in a single set-up on a computer-controlled vertical mill.

3. The tool of claim 1, in which the pin protrudes from a recessed portion of the rear face and has an outer end that remains flush with or recessed below a surrounding portion of the rear face.

4. The tool of claim 1, in which the slide gear is generally rectangular, with sharp edges on an opposed side that faces away from the ratchet.

5. The tool of claim 1, in which the shoulders on the biasing element are curved and the teeth on the ratchet have essentially planar faces.

6. The tool of claim 1, in which:

each shoulder on the biasing element is curved and outwardly flanked by a single recess, the radial distance from the top of the shoulder to the base of the recess being no more than half the difference between the outside diameter and the root diameter of the teeth on the ratchet;

and the teeth on the ratchet have essentially planar faces.

7. The tool of claim 6, in which the centering journal has a spaced wall that forms a vent between the ratchet and the journal.

8. The tool of claim 1, in which the teeth on the ratchet have:

essentially planar faces;

top lands that traverse at least one quarter of the pitch; and bottom lands that extend continuously from the faces, have essentially constant radius, and traverse at least one quarter of the pitch.

9. The tool of claim 1, in which the ratchet is journaled over a centering journal in the ratchet recess.

10. The tool of claim 1, in which the drive stem is adapted to receive a replaceable socket.

11. The tool of claim 1, in which:

each shoulder on the biasing element is curved and outwardly flanked by a single recess, the radial distance from the top of the shoulder to the base of the recess being no more than half the difference between the outside diameter and the root diameter of the teeth on the ratchet; and the teeth on the ratchet have essentially planar faces, top lands that traverse at least one quarter of the pitch, and bottom lands that extend continuously from the faces, have essentially constant radius, and traverse at least one quarter of the pitch.

12. A ratcheting torque wrench that has:

a slide gear that slides laterally in a slide channel in a head that is operatively connected to a torque indicator assembly, the head having closed sides that prevent access to the lateral ends of the slide channel;

a ratchet that is mounted for rotation within a ratchet recess in the head, and has a drive stem that protrudes from a face of the head;

two opposed shoulders that are on the slide gear and face the ratchet;

a biasing element that is selectively positionable in either a clockwise ratcheting position or in a counterclockwise ratcheting position, in each position the biasing element biasing the slide gear laterally to a position where one of the opposed shoulders engages an engaged tooth on the ratchet, but permitting sufficient rotational force to drive the engaged tooth and the slide gear away from a centerline of the wrench until the shoulder disengages from that engaged tooth, the biasing element subsequently driving the previously engaged shoulder back toward the centerline of the wrench, where the shoulder engages a new engaged tooth;

a pin that extends from the slide gear and protrudes from a rear face of the head, enabling a user to slide the slide gear laterally in the slide channel and thus to selectively arrange the wrench in either the clockwise ratcheting position or the counterclockwise ratcheting position.

13. A ratchet wrench that has:

a slide gear that slides laterally in a slide channel in a head that has closed sides that prevent access to the lateral ends of the slide channel;

a ratchet that is mounted for rotation within a ratchet recess in the head, and has a drive stem that protrudes from a working face of the head;

two opposed shoulders on a ratchet side of the slide gear that faces the ratchet;

a biasing element that is selectively positionable in either a clockwise ratcheting position or in a counterclockwise ratcheting position, in each position the biasing element biasing the slide gear laterally to a position where one of the opposed shoulders engages an engaged tooth on the ratchet, but permitting sufficient rotational force to drive the engaged tooth and the slide gear away from a centerline of the wrench until the shoulder disengages from that engaged tooth, the biasing element subsequently driving the previously engaged shoulder back toward the centerline of the wrench, where the shoulder engages a new engaged tooth; and a pin that extends from the slide gear and protrudes from an opposed rear face of the wrench, enabling a user to slide the slide gear laterally and thus selectively arrange the wrench in either the clockwise ratcheting position or the counterclockwise ratcheting position.

14. A ratchet wrench as recited in claim 13, in which the ratchet recess, the slide channel, and all required cavities for the biasing element are recessed from the working face in an arrangement that can machined in a single set-up on a computer controlled vertical mill.

15. A ratchet wrench as recited in claim 13, in which the pin protrudes from a recessed portion of the rear face, and has an outer end that remains recessed below a surrounding portion of the rear face.

16. A ratchet wrench as recited in claim 13, in which the slide gear is generally rectangular, with sharp edges on an opposed side that faces away from the ratchet.

17. A ratchet wrench as recited in claim 13, in which the ratchet fits tightly over a centering journal in the ratchet recess.

18. A ratchet wrench as recited in claim 17, in which the centering journal has a spaced wall that forms a vent between the ratchet and the journal.

19. A ratchet wrench as recited in claim 13, in which the drive stem has a socket.

20. A ratchet wrench as recited in claim 13, in which the drive stem has a replaceable socket.

* * * * *